US011420167B2

(12) United States Patent
Bonner

(10) Patent No.: US 11,420,167 B2
(45) Date of Patent: Aug. 23, 2022

(54) MOBILE CHEMICAL MIXING PLANT

(71) Applicant: Phillip J. Bonner, Lafayette, LA (US)

(72) Inventor: Phillip J. Bonner, Lafayette, LA (US)

( * ) Notice: Subject to any disclaimer, the term of this patent is extended or adjusted under 35 U.S.C. 154(b) by 214 days.

(21) Appl. No.: 16/656,351

(22) Filed: Oct. 17, 2019

(65) Prior Publication Data

US 2020/0122103 A1 Apr. 23, 2020

Related U.S. Application Data

(60) Provisional application No. 62/748,141, filed on Oct. 19, 2018.

(51) Int. Cl.

| | |
|---|---|
| ***B01F 33/00*** | (2022.01) |
| ***E21B 21/00*** | (2006.01) |
| ***B01F 33/502*** | (2022.01) |
| ***E21B 21/06*** | (2006.01) |
| ***B01F 25/313*** | (2022.01) |
| ***B01F 27/72*** | (2022.01) |
| ***B01F 33/82*** | (2022.01) |

(Continued)

(52) U.S. Cl.

CPC ..... *B01F 33/5023* (2022.01); *B01F 25/3131* (2022.01); *B01F 27/72* (2022.01); *B01F 33/82* (2022.01); *B01F 33/846* (2022.01); *B01F 35/187* (2022.01); *E21B 21/062* (2013.01); *B01F 2101/49* (2022.01)

(58) Field of Classification Search

CPC ..... B01F 13/004; B01F 2215/0081; B01F 33/5023; B01F 33/82; B01F 25/3131; B01F 35/187; B01F 27/72; B01F 33/846; B01F 2101/49; E21B 21/062

See application file for complete search history.

(56) References Cited

U.S. PATENT DOCUMENTS 3,936,246 A * 2/1976 Beitzel ..... B01F 5/12 418/1

4,538,221 A 8/1985 Crain et al.

(Continued)

OTHER PUBLICATIONS

"Direct Inject Chemical Mixing Plant", PowerPoint presentation prepared by Yellow Jacket Oilfield Services LLC (Feb. 15, 2017).

(Continued)

*Primary Examiner* — Anshu Bhatia

(74) *Attorney, Agent, or Firm* — Matthews, Lawson, McCutcheon & Joseph, PLLC

(57) ABSTRACT

A mobile chemical mixing plant includes an inlet for receiving fluid; a fluid conduit for conveying the fluid from the inlet; a container for containing a chemical therein; a chemical pump for withdrawing the chemical from the container and directing the chemical into the fluid conduit for mixing with the fluid in the fluid conduit to form a chemical mixture; and a homogenization pump for pumping the chemical mixture in the fluid conduit out of the mobile chemical mixing plant. The fluid conduit connects the chemical pump to the homogenization pump. The mobile chemical mixing plant is fixed to a trailer that is attachable to a vehicle. Because the fluid conduit directly connects the chemical pump to the homogenization pump, the mobile chemical mixing plant does not need an intervening mixing tank for mixing the fluid and the chemical.

18 Claims, 1 Drawing Sheet

(51) Int. Cl.

| | |
|---|---|
| ***B01F 33/84*** | (2022.01) |
| ***B01F 35/00*** | (2022.01) |
| *B01F 101/49* | (2022.01) |

(56) References Cited

U.S. PATENT DOCUMENTS

| | | | | |
|---|---|---|---|---|
| 4,538,222 | A | 8/1985 | Crain et al. | |
| 4,854,714 | A | 8/1989 | Davis et al. | |
| 5,114,239 | A | 5/1992 | Allen | |
| 7,836,949 | B2 | 11/2010 | Dykstra | |
| 2003/0150494 | A1* | 8/2003 | Morgan | B01F 3/0861 137/574 |
| 2015/0238914 | A1* | 8/2015 | Luharuka | B01F 3/1221 366/154.1 |

OTHER PUBLICATIONS

"Mixing Plant Services", Bullet Oilfield Solutions, https://www.bulletoilfieldsolutions.com/services/mixing-plant-services/ (website visited Sep. 25, 2018).

"Mixing Plant", Bullet Oilfield Solutions, https://www.bulletoilfieldsolutions.com/services/mixing-plant (website visited Sep. 25, 2018).

"Chemical Mixing Plants", Chemix Services, https://www.chemixservices.com/services/mixing-plants (website visited Sep. 25, 2018).

"Mobile Chemical Mixing Plants", Drillwell Energy Services, https://www.drillwellenergy.com/copy-of-fluids-solids-handling (website visited Sep. 25, 2018).

"Mixing Plants", Exact Valve Solutions, https://www.exactvalvesolutions.com/mixing-plants (website visited Sep. 25, 2018).

"Mixing Plant Services", Greenwell Solutions, https://www.greenwellsolutions.com/completions/mixingplant.php (website visited Sep. 25, 2018).

"Mixing Plants", Pro Oil & Gas Services, LLC, https://www.proosllc.com/mixing-plants (website visited Sep. 25, 2018).

"Chemical Additive Units", Stewart and Stevenson, https://www.stewartandstevenson.com/markets/oil-gas/frac-well-stim-equipment/combination-chemical-additive (website visited Sep. 25, 2018).

Philip Bonner, "Affidavit of Philip Bonner," pp. 1-8, published Nov. 25, 2019, submitted in the record to Case No. 2018-27396, *TSI Flow Products, Inc. et al.* v. *Force Chem Technologies, LLC et al.*, in the 189th Judicial District Court of Harris County, Texas.†

* cited by examiner
† cited by third party

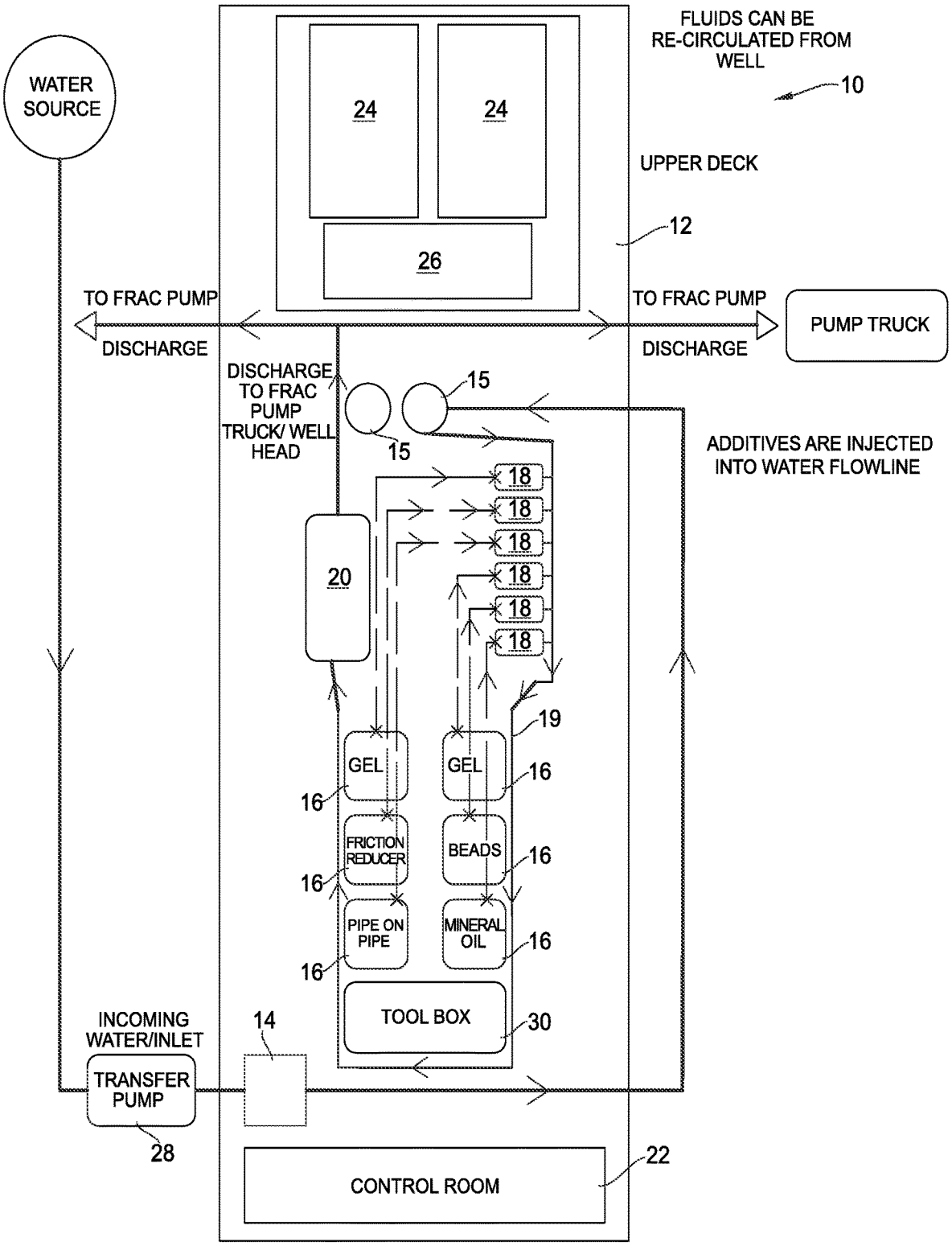
FLUIDS CAN BE RE-CIRCULATED FROM WELL
10
WATER SOURCE
24
24
26
UPPER DECK
12
TO FRAC PUMP
DISCHARGE
TO FRAC PUMP
DISCHARGE
PUMP TRUCK
DISCHARGE TO FRAC PUMP TRUCK/ WELL HEAD
15
15
ADDITIVES ARE INJECTED INTO WATER FLOWLINE
18
18
18
18
18
18
20
19
GEL
GEL
16
16
FRICTION REDUCER
BEADS
16
16
PIPE ON PIPE
MINERAL OIL
16
16
TOOL BOX
30
INCOMING WATER/INLET
14
TRANSFER PUMP
28
CONTROL ROOM
22

MOBILE CHEMICAL MIXING PLANT

PRIOR APPLICATION

This application claims the benefit of U.S. Provisional Application No. 62/748,141, filed on Oct. 19, 2018. The disclosure of the prior application is hereby incorporated by reference herein in its entirety.

FIELD

Embodiments usable within the scope of the present disclosure relate, generally, to a mobile chemical mixing plant for oilfield operations, such as fracing. A preferred embodiment relates to a trailer-mounted chemical mixing plant utilizing a tank-less, in-line chemical mixing system.

BACKGROUND

Generally, oilfield mixing plant units are used to enhance the fluid capabilities and chemical hydration of a coil tubing unit during the drill out of plugs. In other cases, the mixing plant units are used to clean out laterals and toe preps before fracing. The plants have the ability to mix chemicals associated with a friction reducer, a pipe on pipe lubricant, a xanthan slurry, and a biocide. Oilfield mixing plants have been mounted on a vehicle trailer to make the plants mobile.

One problem with conventional mobile mixing plants is that they employ one or more mixing tanks for mixing the chemicals with a solution, and a have dedicated pump for each mixing tank. The mixing tanks take up premium space on the trailer, add extra weight to the trailer, and can slow down the delivery process because of the time it takes to mix the fluids in the tank.

Therefore, a need exists for a mobile chemical mixing plant that eliminates the need for mixing tanks and their dedicated pumps.

The present embodiments meet these needs.

SUMMARY

Embodiments of the present disclosure relate generally to mobile chemical mixing plant that utilizes an in-line pumping system that eliminates the need for mixing tanks and their dedicated pumps.

In one embodiment, a mobile chemical mixing plant comprises an inlet for receiving fluid; a fluid conduit for conveying the fluid from the inlet; a container for containing a chemical therein; a chemical pump for withdrawing the chemical from the container and directing the chemical into the fluid conduit for mixing with the fluid in the fluid conduit to form a chemical mixture; and a homogenization pump for pumping the chemical mixture in the fluid conduit out of the mobile chemical mixing plant, wherein the fluid conduit connects the chemical pump to the homogenization pump.

In an embodiment, the mobile chemical mixing plant further comprises a filter for cleaning the fluid received at the inlet.

In embodiment, the mobile chemical mixing plant is fixed to a trailer that is attachable to a vehicle.

In embodiment, the homogenization pump is an in-line homogenization rotary/worm pump.

In embodiment, the mobile chemical mixing plant further comprises a control room that includes a computer for controlling and monitoring at least the inlet, the chemical pump, the container, and the homogenization pump.

In embodiment, the mobile chemical mixing plant further comprises a generator for supplying power to the mobile chemical mixing plant.

In embodiment, the fluid conduit comprises a diameter in the range of 2 inches to 4 inches, and is formed of one of nylon and rubber.

In another embodiment, a method of mixing a chemical with a fluid in a mobile chemical mixing plant comprises receiving fluid at an inlet of the mobile chemical mixing plant; conveying the fluid from the inlet in a fluid conduit; withdrawing, via a chemical pump, a chemical from a container on the mobile chemical mixing plant and directing the chemical into the fluid conduit for mixing with the fluid in the fluid conduit to form a chemical mixture; and pumping, via a homogenization pump, the chemical mixture in the fluid conduit out of the mobile chemical mixing plant, wherein the fluid conduit connects the chemical pump to the homogenization pump.

In embodiment, the method further comprises cleaning the fluid received at the inlet.

In embodiment, the method further comprises controlling and monitoring at least the inlet, the chemical pump, and the homogenization pump via a computer in a control room on the mobile chemical mixing plant.

In embodiment, the method further comprises supplying power to the mobile chemical mixing plant via a generator.

In a further embodiment, a system for mixing a chemical with a fluid in a mobile chemical mixing plant comprises a fluid source; a trailer that is attachable to a vehicle, the trailer comprising a mobile chemical mixing plant comprising: an inlet for receiving fluid from the fluid source; a fluid conduit for conveying the fluid from the inlet; a container for containing a chemical therein; a chemical pump for withdrawing the chemical from the container and directing the chemical into the fluid conduit for mixing with the fluid in the fluid conduit to form a chemical mixture; and a homogenization pump for pumping the chemical mixture in the fluid conduit out of the mobile chemical mixing plant, wherein the fluid conduit connects the chemical pump to the homogenization pump; a frac pump for receiving the chemical mixture from the homogenization pump, and distributing the chemical mixture from the frac pump to one of a pump truck and a wellhead.

In embodiment, the trailer further comprises a filter for cleaning the fluid received at the inlet.

In embodiment, the trailer further comprises a control room that includes a computer for controlling and monitoring at least the inlet, the chemical pump, the container, and the homogenization pump.

In embodiment, the system further comprises a generator for supplying power to the mobile chemical mixing plant.

BRIEF DESCRIPTION OF THE DRAWINGS

In the detailed description of various embodiments usable within the scope of the present disclosure, presented below, reference is made to the accompanying drawing, in which:

FIG. 1 is schematic diagram of a mobile chemical mixing plant according to an embodiment.

One or more embodiments are described below with reference to the listed FIGURE.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

FIG. 1 illustrates a schematic diagram of a mobile chemical mixing plant 10 according to an embodiment. The schematic is similar to a plan view of the mobile chemical mixing plant 10. The mobile chemical mixing plant 10 may be provided on the upper deck 12 of a trailer that may be pulled behind a vehicle, such as a truck. The trailer may have a length of 48 feet in one embodiment, although that length is not limiting. The trailer may have a length that is greater than or less than 48 feet in other embodiments. The mobile chemical mixing plant 10 includes an inlet 14 for receiving water, as a solution, from a water source. The inlet 14 may also receive potassium chloride (KCl) and/or other fluid. Water, KCl, and/or other fluid from the inlet 14 may be passed through one or more filters 15, such as filter pods, to purify/clean the water, KCl, and/or other fluid. The filtered water, KCl, and/or other fluid may then be directed into a fluid conduit 19 for mixing with one or more chemicals. The one or more chemicals may be provided in separate replaceable containers, such as totes 16. The totes 16 may each have a capacity of 330 gallons, although larger or smaller capacity totes may be used. The chemicals in the totes 16 may include Gel, a friction reducer, beads for fracing operations, a pipe-on-pipe lubricant, and mineral oil. The friction reducer may be used as a lube for a stator rubber in the motor of a downhole tool. The gel may be used to improve viscosity characteristics.

The totes 16 may be connected to chemical pumps 18 that withdraw the chemicals from the respective tote 16 and direct the pumped chemicals into the conduit 19 for mixing with the filtered water, KCl, and/or other fluid from the filters 15. The chemical pumps 18 may be high pressure injection pumps. The high pressure injection pumps may deliver fluids three to five times faster than micro-feed low pressure pumps used conventionally. With such a higher pressure and speed, the chemicals pumped from the chemical pumps 18 can beneficially begin mixing with the filtered water, KCl, and/or other fluid in the fluid conduit 19 that leads to a homogenization pump 20. The homogenization pump 20 may be an in-line homogenization rotary/worm pump allows for rapid hydration and on-demand delivery of fully mixed fluids. The homogenization pump 20 reduces overall mixing time in the mobile chemical mixing plant 10. The homogenization pump 20 thus provides more efficiency in the mixing process, allowing for a faster mix, fluid delivery rate, and speed. The homogenization pump 20 may distribute the chemical mixture to off-board frac pumps (not illustrated in FIG. 1) for transmission to a pump truck or directly to the wellhead. This in-line system allows for the chemicals to be directly infused for proper viscosity without the need for a mixing tank. That is, the mobile chemical mixing plant 10 does not include a mixing tank for mixing the water, KCl, and/or other fluid and the chemicals from the totes 16. The water, KCl, and/or other fluid and the chemicals from the totes 16 are transmitted into the conduit 19 and then directly to the homogenization pump 20, so that there is no intervening mixing tank in the fluid line between the chemical pumps 18 and the homogenization pump 20. In this regard, the fluid conduit 19 directly connects the chemical pumps 18 to the homogenization pump 20. Thus, all chemicals, distribution rates, viscosity and pressures can be strictly monitored to ensure optimal results. Further, the delivery of the mixed fluids is expedited by the in-line homogenization pump 20, as there is no "down-time" associated with the waiting time for hydration in a mixing tank (as in the conventional art). In addition, space on the upper deck 12 of the trailer is saved, and the mobile chemical mixing plant 10 is lighter in weight, which may decrease fuel costs when transporting the mobile chemical mixing plant 10.

Additional components of the mobile chemical mixing plant 10 may include a control room 22. The control room 22 may be air-conditioned, and include computers, central processing units, monitors, and associated software programs for controlling and monitoring the components of the system, such as the chemical pumps 18 and the homogenization pump 20. The software programs may be executed by the central processing units. The software programs may also monitor and acquire and record system data, such a wellhead pressure, fluid pressure, flow rate, mixing rate, circulating pressure, and fluid temperature and density. The computer and the software programs may be referred to collectively or individually as an acquisition unit. The software programs may further enable real-time system monitoring and information sharing via Wi-Fi, and may also generate job and chemical reports. Generators 24 may be provided to supply power to the components of the mobile chemical mixing plant 10. The generators 24 may provide electrical power to the mobile chemical mixing plant 10 and its components. Additional components may include an air compressor 26, a water transfer pump 28, and a tool box 30.

The conduits connecting the components of the mobile chemical mixing plant 10 may be formed of nylon or rubber material, as opposed to steel plumbing, so as to provide relatively lighter weight to the mobile chemical mixing plant 10. Moreover, the nylon or rubberized hoses may allow more versatility in rerouting fluids in the system according to specific job application or customer needs. The conduits may be detachable/connectable with each other and/or other components of the mobile chemical mixing plant 10. The nylon or rubberized hoses may be detachable so as to be connected on the mobile chemical mixing plant 10 in different configurations. This design allows for specific job applications to be modified "on the fly", providing for adjustments in conduit configuration and delivery methods according to various and unique situations at the job site. The connecting conduits may be from 2 inches to 4 inches in diameter. The mobile chemical mixing plant 10 may also include a viscometer and tapping valve (not shown) that allows a technician to physically test or handle the viscosity of the fluids.

A method of mixing the chemicals with the water or other fluid in the mobile chemical mixing plant 10 may comprise receiving the water and/or other fluid at an inlet 14, and conveying the water or other fluid from the inlet 14 into a fluid conduit 19. The method may further comprise withdrawing, via one or more chemical pumps 18, one or more chemicals from one or more containers, such as totes 16, on the mobile chemical mixing plant 10 and directing the one or more chemicals into the fluid conduit 19 for mixing with the water and/or other fluid in the fluid conduit 19 to form a chemical mixture. The chemical mixture in the fluid conduit 19 is then pumped, via the homogenization pump 20, out of the mobile chemical mixing plant 10. In the method, the fluid conduit 19 directly connects the one or more chemical pumps 18 to the homogenization pump 20 so that there is no intervening mixing tank between the one or more chemical pumps 18 and the homogenization pump 20. Thus, all chemicals, distribution rates, viscosity and pressures can be strictly monitored to ensure optimal results. Further, the delivery of the mixed fluids is expedited by the in-line homogenization pump, as there is no "down-time" associated with the waiting time for hydration in a mixing tank (as in the conventional art). In addition, space on the upper deck 12 of the trailer is saved, and the mobile chemical mixing plant 10 is lighter in weight, which may decrease fuel costs when transporting the mobile chemical mixing plant 10.

A system for mixing one or more chemicals with water and/or other fluid in a mobile chemical mixing plant 10 may include a fluid source, a trailer, and a frac pump off-board of the trailer. The trailer may be of the type that is attachable to a vehicle, and comprises the mobile chemical mixing plant 10 as discussed herein. The off-board frac pump may receive the chemical mixture from the homogenization pump 20, and may distribute the chemical mixture from the frac pump to a pump truck or a wellhead.

While various embodiments usable within the scope of the present disclosure have been described with emphasis, it should be understood that the present invention can be practiced other than as specifically described herein.

What is claimed is:

1. A mobile chemical mixing plant comprising:

an inlet for receiving fluid;

a fluid conduit for conveying the fluid from the inlet;

a first container for containing a first chemical therein and a second container for containing a second chemical therein;

a first chemical pump upstream of the fluid conduit for withdrawing the first chemical from the first container and directing the first chemical into the fluid conduit for mixing with the fluid in the fluid conduit;

a second chemical pump upstream of the fluid conduit for withdrawing the second chemical from the second container and directing the second chemical into the fluid conduit for mixing in the fluid conduit with the fluid and the first chemical to form a chemical mixture; and a homogenization pump for pumping the chemical mixture in the fluid conduit out of the mobile chemical mixing plant, wherein the fluid conduit connects the first chemical pump and the second chemical pump to the homogenization pump.

2. The mobile chemical mixing plant according to claim 1, fur her comprising:

a filter for cleaning the fluid received at the inlet.

3. The mobile chemical mixing plant according to claim 1, wherein the mobile chemical mixing plant is fixed to one trailer that is attachable to a vehicle.

4. The mobile chemical mixing plant according to claim 1, wherein the homogenization pump is an in-line homogenization rotary/worm pump.

5. The mobile chemical mixing plant according to claim 1, further comprising a control room that includes a computer for controlling and monitoring at least the inlet, the chemical pump, the container, and the homogenization pump.

6. The mobile chemical mixing plant according to claim 1, further comprising a generator for supplying power to the mobile chemical mixing plant.

7. A mobile chemical mixing plant comprising:

an inlet for receiving, fluid;

a fluid conduit for conveying the fluid from the inlet;

a container for containing a chemical therein;

a chemical pump for withdrawing the chemical from the container and directing the chemical into the fluid conduit for mixing with the fluid in the fluid conduit to form a chemical mixture; and a homogenization pump for pumping the chemical mixture in the fluid conduit out of the mobile chemical mixing plant, wherein the fluid conduit connects the chemical pump to the homogenization pump, and wherein the fluid conduit comprises a diameter in the range of 2 inches to 4 inches, and is formed of one of nylon and rubber.

8. A method of mixing a chemical with a fluid in a mobile chemical mixing plant, comprising:

receiving fluid at an inlet of the mobile chemical mixing plant;

conveying the fluid from the inlet in a fluid conduit;

withdrawing, via a first chemical pump upstream of the fluid conduit, a first chemical from a first container on the mobile chemical mixing plant;

withdrawing, via a second chemical pump upstream of the fluid conduit, a second chemical from a second container on the mobile chemical mixing plant;

directing the first chemical and the second chemical into the fluid conduit for mixing with the fluid in the fluid conduit to form a chemical mixture; and pumping, via a homogenization pump, the chemical mixture in the fluid conduit out of the mobile chemical mixing plant, wherein the fluid conduit connects the first chemical pump and the second chemical pump to the homogenization pump.

9. The method according to claim 8, further comprising:

cleaning the fluid received at the inlet.

10. The method according to claim 8, further comprising:

controlling and monitoring at least the inlet, the chemical pump, and the homogenization pump via a computer in a control room on the mobile chemical mixing plant.

11. The method according to claim 8, further comprising:

supplying power to the mobile chemical mixing plant via a generator.

12. A system for mixing a chemical with a fluid comprising:

a fluid source;

one trailer that is attachable to a vehicle, the one trailer comprising a mobile chemical mixing plant comprising:

an inlet for receiving fluid from the fluid source;

a fluid conduit for conveying the fluid from the inlet;

a first container for containing a first chemical therein;

a first chemical pump upstream of the fluid conduit for withdrawing the first chemical from the first container and directing the first chemical into the fluid conduit for mixing with the fluid in the fluid conduit to form a chemical mixture; and a homogenization pump for pumping the chemical mixture in the fluid conduit out of the mobile chemical mixing plant, wherein the fluid conduit connects the first chemical pump to the homogenization pump;

a frac pump for receiving the chemical mixture from the homogenization pump, and distributing the chemical mixture from the frac pump to one of a pump truck and a wellhead.

13. The system according to claim 12, wherein the trailer further comprises a filter for cleaning the fluid received at the inlet.

14. The system according to claim 12, wherein the trailer further comprises a control room that includes a computer for controlling and monitoring at least the inlet, the chemical pump, the container, and the homogenization pump.

15. The system according to claim 12, further comprising a generator for supplying power to the mobile chemical mixing plant.

16. The system according to claim 12, further comprising:

a second container for containing a second chemical therein;

a second chemical pump upstream of the fluid conduit for withdrawing the second chemical from the second container, and directing the second chemical into the fluid conduit for mixing with the fluid in the fluid conduit to form the chemical mixture.

17. An in-line mobile chemical mixing plant comprising:

one trailer that is attachable to a vehicle, the one trailer comprising:

an inlet fur receiving fluid;

a fluid conduit for conveying the fluid from the inlet;

a container for containing a chemical therein;

a chemical pump upstream of the fluid conduit for withdrawing the chemical from the container and directing the chemical into the fluid conduit for mixing with the fluid in the fluid conduit to form a chemical mixture; and an in-line homogenization pump for pumping the chemical mixture in the fluid conduit out of the mobile chemical mixing plant, wherein the fluid conduit connects the chemical pump to the in-line homogenization pump, and wherein the one trailer does not include a mixing tank nor a hydration tank.

18. The in-line mobile chemical mixing plant according to claim 17, further comprising:

a second container for containing a second chemical therein; and a second chemical pump upstream of the fluid conduit for withdrawing the second chemical from the second container, and directing the second chemical into the fluid conduit for mixing with the fluid in the fluid conduit to form a chemical mixture.

* * * * *